US005834116A

United States Patent [19]

Sawa et al.

[11] Patent Number: 5,834,116

[45] Date of Patent: Nov. 10, 1998

[54] ELECTROCONDUCTIVE ROLLER

[75] Inventors: Eiji Sawa; Yuichiro Mori; Miho Saito, all of Kanagawa-ken, Japan

[73] Assignee: Bridgestone Corporation, Tokyo, Japan

[21] Appl. No.: 374,543

[22] PCT Filed: May 19, 1994

[86] PCT No.: PCT/JP94/00804

§ 371 Date: Apr. 8, 1996

§ 102(e) Date: Apr. 8, 1996

[30] Foreign Application Priority Data

May 19, 1993 [JP] Japan ..... 5-140012

[51] Int. Cl.[6] ..... D02G 3/00

[52] U.S. Cl. ..... 428/375; 428/379; 428/423.1; 428/425.8; 428/906; 492/53; 492/56; 492/59; 355/284

[58] Field of Search ..... 428/98, 411.1, 428/421, 358, 330, 447, 906, 372, 375, 379, 423.1, 425.8; 355/284; 219/216; 430/98, 99; 492/53, 54, 59, 56

[56] References Cited

U.S. PATENT DOCUMENTS

| | | |
|---|---|---|
| 4,618,630 | 10/1986 | Knobel et al. . |
| 5,076,201 | 12/1991 | Nishio et al. . |
| 5,082,870 | 1/1992 | Fududa et al. . |
| 5,096,934 | 3/1992 | Roberts et al. . |
| 5,241,343 | 8/1993 | Nishio . |

*Primary Examiner*—William Krynski
*Assistant Examiner*—J. M. Gray
*Attorney, Agent, or Firm*—Jordan and Hamburg

[57] ABSTRACT

An electroconductive roller working stably in all environmental conditions without any large-capacity power supply and which is suitable for use in a system of which the power source is controlled for a constant current. The electroconductive roller has a resistance of $1\times10^3$ to $1\times10^{12}$ Ω when applied with a voltage of 500 V at a temperature of 25° C. and relative humidity of 50% and has $K_{HH} \leqq K_{NN} \leqq K_{LL}$, where K is a ratio of roller resistance at an application of 500 V to roller resistance at an application of 2,000 V, $K_{HH}$ is the ratio K at ambient conditions of 35° C. and 85% relative humidity, $K_{NN}$ is the ratio K at ambient conditions of 25° C. and 50% relative humidity, and $K_{LL}$ is the ratio K at ambient conditions of 10° C. and 15% relative humidity.

4 Claims, 1 Drawing Sheet

ELECTROCONDUCTIVE ROLLER

BACKGROUND OF THE INVENTION

The present invention relates to an electroconductive roller which controls the static electricity on an object with which it is in contact, such as a toner supply roller, developing roller, transfer roller, cleaning roller or the like used in a printer of electrophotography and electrostatic recording systems.

Generally, the conventional electrophotographic process in which a toner is supplied from a toner cartridge to a light-sensitive object on which an electrostatic latent image is formed, transferred onto a sheet of paper and fixed thereon, includes (1) charging, (2) exposure, (3) development, (4) transfer, (5) fixation and (6) discharging. In each of these processes, various types of rollers are used to precisely control the static electricity on an object with which they are in contact. Recently, the requirements for the materials of such rollers have become increasingly stricter. The resistance of these rollers is measured under different ambient conditions or environments including: (1) a temperature of 35° C. and a relative humidity of 85%, referred to as the "H/H environment;" (2) a temperature of 25° C. and a relative humidity of 50%, referred to as the "N/N environment;" and (3) a temperature of 10° C. and a relative humidity of 15%, referred to as the "L/L environment."

Since the rollers used in a developing mechanism such as a toner supply roller, developing roller and transfer roller, and those used in a cleaning mechanism, control the static electricity on a contacting object, they are required to have mechanical and electrical characteristics both better than ever. Heretofore, the polyurethane resin has been used in the form of a foam or elastomer to make such rollers because of its high durability, flexibility, low compression-caused permanent setting and low staining. In a urethane resin containing no electrically conductive additive, water and impurities existing therein will act as carrier and are slightly conductive. This mechanism of conduction is regarded as an ionic conduction, and the electrical property of the urethane resin is characteristic of the ionic conduction. A roller made of such an ordinary urethane resin shows a resistance of $\mathbf{10}^7$ to $\mathbf{10}^9$ Ω in the H/H environment while the resistance is $\mathbf{10}^9$ to $\mathbf{10}^{11}$ Ω in the LL environment. Namely, the resistance in the H/H environment is more than tens different from that in the L/L environment. The resistance varies little when a voltage is applied to the urethane resin.

In case such a roller is used, especially when it is used as connected to a power source controlled to a constant current, its resistance is low in the H/H environment so that a low voltage develops under the constant-current control. Since the roller shows a high resistance in the L/L environment, a high voltage develops. Many power sources controlled for a constant current, used in ordinary electrophotography systems, are controlled to 0.1 to 30 μA. Assume, for example, a roller showing a resistance of $1\times10^8$ Ω in the H/H environment while showing $2\times10^{10}$ Ω in the L/L environment. If the roller is used as fed from a power source controlled to a constant current of 1 μA, then voltages of 100 V and 20,000 V are developed in the respective environments. Thus, in case this roller is used, a high voltage is required in the L/L environment so that the capacity of the power source has to be increased and a countermeasure for discharging has to be taken, which will be disadvantageous economically and in terms of space. Also, in case the roller is used as connected to a power source of which the capacity is fixed and insufficient, the capacity is insufficient in the L/L environment so that no necessary magnitude of current is available, possibly causing a problem in imaging and the like.

To overcome the above drawbacks of the prior art, it has been proposed to lower the resistance of the roller by adding to the materials of the roller a substance which makes the roller electrically conductive by ionic conduction (hereinafter referred to as an "ionic conduction-imparting substance") or addition of a large amount of a substance which makes the roller electrically conductive by electronic conduction (hereinafter referred to as an "electronic conduction-imparting substance"), such as carbon.

However, the addition of an ionic conduction-imparting substance will possibly cause the roller resistance to be lower in the L/L environment as well as in the H/H environment so that the electricity developed in the H/H environment will be extremely small, causing problems (poor transfer, poor development, etc.) in the image and other problems.

Also, for lowering the roller resistance by addition of an electronic conduction-imparting substance, such as carbon, etc., an electronic conduction-imparting substance has to be added in a large amount in order to lower the roller resistance in the H/H, N/N and L/L environments to intended values, respectively. The majority of the electronic conduction-imparting substances includes a powder or fiber insoluble in urethane resin, such as carbon, metal, metal oxide, etc. When a large amount of such a substance is mixed in the materials of a urethane resin, the viscosity of the material increases, causing problems in resin production, molding and other processes. Especially in the process of resin foaming, it is extremely difficult to control the foams in the resin. The mixing of the large amount of powder or the like will cause the resin when cured to be harder and lose flexibility.

The rollers used in an electrophotography system and so forth are made of a urethane resin as well as an EDPM or silicon in which an electronic conduction-imparting substance such as carbon is mixed. In many cases, however, such rollers will contaminate, or modify by a chemical reaction, an object with which they are in contact. The rollers incur a large compression-caused permanent setting or similar problems, which are caused by the nature of the rubber itself.

Accordingly, the present invention aims at providing an electro- conductive roller suitably usable in systems operating with a power source, not large-capacity but controlled to a constant current and which can work stably in all environmental conditions.

SUMMARY OF THE INVENTION

The present invention provides an electroconductive roller having a resistance of $1\times10^3$ to $1\times10^{12}$ Ω when applied with a voltage of 500 V at a temperature of 25° C. and relative humidity of 50% and having $K_{HH} \leqq K_{NN} < K_{LL}$, where K is a ratio of a roller resistance a temperature of 35° C. and relative humidity of 85% $K_{NN}$ is the ratio K at ambient conditions of 25° C. and 50%RH and $K_{LL}$ is the ratio K at ambient conditions of 10° C. and 15%RH.

Also, since a current through the roller in the L/L environment can be obtained at a low voltage, no large-capacity voltage generator is required for the present invention. Use of an electroconductive roller thus designed according to the present invention in an electrophotography or similar image recording system in which the source current is controlled to a constant value permits minimization of the change in generated voltage due to an environmental variation and provides a stable voltage and current in all environments, thereby providing quality images.

A roller made of any of the ordinary polyurethane resins showed a high resistance when used in the L/L environment. If the roller was used under the constant-current control, a high voltage was produced. In this case, the resistance change ratio $K_{LL}$ of this roller at application of the voltages was as shown below:

$K_{LL} \approx K_{NN} \approx K_{HH} 1$

The roller was made of a urethane resin to which an ionic conduction-imparting substance was added to lower its entire resistance. It showed a large environment-caused change in resistance, causing a problem when used in the H/H or L/L environment. The resistance change ratio $K_{LL}$ of this roller at application of the voltages was as shown below:

$K_{LL} \approx K_{NN} \approx K_{HH} \approx 1$

To lower the entire resistance, a large amount of an electronic conduction-imparting substance was added. There occurred many problems in the resin molding process as well. An attempt to obtain a low-density and -hardness urethane foam resulted only in such a one as had nonuniform cells, a high density and hardness. In case the roller was made of an elastomer, the resin was very hard. The resistance change ratio of this roller at application of the voltages was as shown below:

$K_{LL \sim KNN} \approx K_{HH} \approx 70$

As a result of many tries and errors, it was found that a design of the roller for a resistance change ratio at application of the voltages $K_{HH} \leqq K_{NN} \leqq K_{LL}$ could solve all the above-mentioned problems. In view of the processibility, resin hardness, etc., the resistance change ratio K should preferably be $0.9 \leqq K_{HH} \leqq 2$ and $2\ K_{LL} \leqq 50$, and more preferably $0.9 \leqq K_{HH} \leqq 2$ and $2 \leqq K_{LL} \leqq 20$ for the article of manufacture to be stable in nature.

DETAILED DESCRIPTION OF THE INVENTION

The preferred embodiments of the present invention will be described further in detail with reference to the drawings.

Polyurethane resin is made mainly from a polyhydroxyl compound, organic polyisocyanate compound, catalyst, cross-linking agent, etc. To foam the polyurethane, a foaming agent and foam stabilizer are added to the above components as necessary.

The polyhydroxyl compound may be selected from among ordinary polyols including a polyol used to produce ordinary soft urethane foam and urethane elastomer, namely, a polyether polyol terminated by a hydroxyl group, polyether polyester polyol being a copolymer of the polyether polyol and polyester polyol and a so-called polymeric polyol derived through polymerization of unsaturated ethylenic monomer in polyol.

The polyisocyanate compound may be selected from among polyisocyanates usable to produce an ordinary soft urethane foam and urethane elastomer. Namely, the polyisocyanates include a tolylene diisocyanate (TDI), crude TDI, 4,4'-diphenylmethane diisocyanate (MDI), crude MDUI, aliphatic polyisocyanates having 2 to 18 carbon atoms, aliphatic polyisocyanates having 4 to 15 carbon atoms, aromatic polyisocyanates having 8 to 15 carbon atoms, mixtures and modified compounds of such polyisocyanates, such as prepolymers that are obtained by partially reacting polyisocyanates with polyol. According to the present invention, a catalyst may be selected from among well-known organic metal compounds such as dibutyltin dilayrate, tin octylate and zinc octylate, alkali and alkaline earth metals such as alkoxide and phenoxide, tertiary amines such as triethylamine, triethyldiamine, N-methyl morpholine and dimethylaminomethyl phenol, quaternary ammonium compounds, and imidazoles. They may also include a nickel acetyl acetonate, diacetyl acetonate nickel, etc. as disclosed in the Japanese Examined Patent Publication No. Sho 53-8735. The foam stabilizer may be freely selected from among well-known ones usable for expanding the polyurethane resin. The other additives used to produce the electroconductive roller according to the present invention may be selected from among well-known pigments, dyes, organic or inorganic fillers that are usable to produce urethane foam and elastomer.

The polyurethane foam is produced through production of an elastomer by mixing and dispersing in the above-mentioned polyurethane resin an electronic conduction-imparting substance (and another substance, namely, an ionic conduction-imparting substance when necessary) and foaming it by mechanically mixing air or inert gas in the elastomer.

Figure 1:
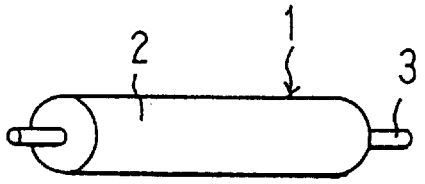
FIG. 1 is a perspective view of the electroconductive roller.

The elastomer or polyurethane foam is used to produce the roller shaped as shown in FIG. 1. The roller made of the elastomer for use in an electrophotography or the like should preferably have an Asker C hardness of 80° or less, and more preferably of 75° or less since any high hardness will result in a poor contact of the roller with a counterpart. For the same reason, the roller made of the polyurethane foam should preferably have an Asker C hardness of 65° or less, and more preferably of 60° or less and a mean cell diameter of 500 $\mu$m or less and more preferably of 300 $\mu$m or less.

The particulate or fibrous electronic conduction-imparting substances may be selected from among powder or chopped fiber strands of ordinary conductive carbon and graphite, powder or fibers of conductive metals such as copper, nickel and silver, conductive fine powder of metal oxides such as tin oxide, titanium oxide and indium oxide or of organic substances such as polyaniline, polypyrol and polyacetal. The amount of such substance to be added is adjustable according to an intended roller resistance and kind of the substance. Generally, however, it is so adjusted that the roller resistance change ratio K (roller resistance at application of 500 V/that at application of 2,000 V) of $0.9 \leqq K_{HH} \leqq K_{NN} < K_{LL} < 100$ while the roller resistance in the L/L environment at application of 2,000 V is within a range of $1 \times 10^4$ to $1 \times 10^9$ Ω or preferably of $1 \times 10^8$ to $1 \times 10^{10}$ Ω.

The ionic conduction-imparting substances may be selected from among ordinary antistatic agents including anionic surface active agents such as quaternary ammonium, cationic surface active agents such as aliphatic sulphonate, higher alcohol ester sulphonate, higher alcohol ethylene oxide-added ester sulphonate, higher alcohol ester phosphate and higher alcohol ethylene oxide added ester phosphate, amphoteric surface active agents such as betaine and nonionic surface active agents such as higher alcohol ethylene oxide, polyethylene glycol ester of fatty acid and polyhydric alcohol ester of fatty acid, and such antistatic agents with more than at least one group having an active hydrogen reactive with isocyanate such as hydroxyl group, first or second amine group. Furthermore, such substances may be selected from among $LiCF_3SO_3$, $NaClO_4$, $LiClO_4$, $LiAsF_6$, $LiBF_4$, NaSCN, KSCN and NaCl that are the metallic salts of Li+, Na+ and K+ in Group I of the periodic table, electrolytes of salts such as NH4+, metallic salts of $Ca^{++}$, $Ba^{++}$, etc. in Group II of the periodic table such as $Ca(ClO_4)$, complexes of the metallic salts with polyhydric alcohols and their derivatives such as 1,4-butanediol, ethylene glycol, polyethylene glycol, polypylene glycol and polyethylene glycol, and complexes of metallic salts with mono-ols such as ethylene glycol, monomethyl ether and ethylene glycol monoethyl ether. The amount of such substance to be added is adjustable according to the intended roller resistance and the type of substance having the ionic conduction mechanism. Generally, however, it is so adjusted for the roller resistance change ratio K be as specified above while the roller resistance in the H/H environment at application of 500 V is within a range of $1\times10^4$ to $1\times10^9$ Ω or preferably of $1\times10^5$ to $1\times10^8$ Ω in the H/H environment. In case the intended resistance is relatively high (more than $1\times10_7$ Ω), no ionic conduction-imparting substance is added to the polyurethane resin but the ion conduction by water and impurities in the polyurethane resin is used to attain the above-mentioned roller resistance change ratio K.

Figure 2:
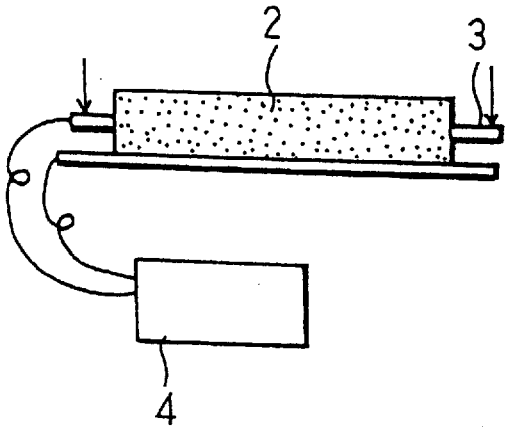
FIG. 2 shows a method for measuring the roller resistance.

Comparative example 1:

The following were used as materials to produce a polyurethane foam:

- 100 parts of polyether polyol (OH value of 33) produced by adding propylene oxide and ethylene oxide to glycerin and which has a molecular weight of 5,000 (EXENOL® 828 available from Asahi Glass Company)
- 25 parts of urethane-modified MDI (SUMIDUR® PF available from Sumitomo Bayer Urethane Co., Ltd.), NCO %=23%,
- 2.5 parts of 1,4-butanediol
- 1.5 parts of silicon surface active agent (L-520 available from Nippon Unicar Co., Ltd.)
- 0.01 part of dibutyltin dilaurate The materials were combined in a 1-liter plastic vessel and agitated for 2 min by a hand-held foamer. A foam thus obtained had fine uniform cells. The foam was poured into a mold of 250 mm in length, 30 mm in width and 30 mm in depth, and cured as it was heated at 140° C. for 20 min. The resulting foam 2 had an Asker C hardness of 44°, density of 0.56 g/cm$^3$ and cell diameter of 120 μm. An electroconductive roller 1 was made from the foam 2 as shown in FIG. 1. The roller 1 consisted of the foam 2 and a shaft 3. The foam 2 had a diameter of 20 mm and a length of 210 mm, and the shaft 3 had a diameter of 6 mm and a length of 270 mm. As shown in FIG. 2, the roller 1 was applied with a weight of 500 g at either end of the shaft 3. A resistance meter 4 was used to measure the resistance in ohms (Ω) of the roller 1 when applied with a voltage of 500 V and 2,000 V, respectively, in the L/L, N/N and H/H environments, respectively. The measurements were as shown in Table 1.

TABLE 1

(in Ω)

| Applied voltage | Environment L/L | N/N | H/H |
|---|---|---|---|
| 500 V | $1.2\times10^{10}$ | $1.1\times10^9$ | $9.2\times10^7$ |
| 2,000 V | $1.2\times10^{10}$ | $1.1\times10^9$ | $9.2\times10^7$ |

For evaluation of the roller, it was used as a transfer roller which operates under a constant-current control in a commercially available laser beam printer. The evaluation results were as follows:

The roller provided quality images in the N/N and H/H environments, but the quality of the images produced by the roller in the L/L environment was poor. It was judged to have been caused by an insufficient power of the voltage generator used with the laser beam printer.

EXAMPLE 1

ASAHI THERMAL, FT class available from Asahi Carbon Co., Ltd., was added in increasing amounts to the mixture in the above Comparative example 1 while observing the variation of the roller resistance change ratio in the L/L environment at application of 500 V and 2,000 V, respectively. Finally, a similar roller to that in the Comparative example 1 was made with ASAHI THERMAL, FT class, added in 5.0 parts. The roller was subjected to a similar evaluation to that in the Comparative example 1. The measured roller resistances were as shown in Table 2. The density was 0.56 g/cm$^3$, the Asker C hardness was 45°, and the mean cell diameter was 150 μm. The roller provided quality images in the L/L environment. Also in the N/N and H/H environments, the roller offered good images.

TABLE 2

(in Ω)

| Applied voltage | Environment L/L | N/N | H/H |
|---|---|---|---|
| 500 V | $9.5\times10^9$ | $1.0\times10^9$ | $9.0\times10^7$ |
| 2,000 V | $7.0\times10^8$ | $5.0\times10^8$ | $9.0\times10^7$ |

COMPARATIVE EXAMPLE 2

Quaternary ammonium, KS-555, available from Kaoh, was added in 0.05 part as an ionic conduction-imparting substance to the mixture in the above Comparative example 1. The polyurethane resin thus obtained was used to make a roller. The measured resistances of this roller were as shown in Table 3. The roller showed a density of 0.56 g/cm$^3$, Asker C hardness of 44° and mean cell diameter of 120 μm. The images the roller provided were of poor quality.

TABLE 3

(in Ω)

| Applied voltage | Environment L/L | N/N | H/H |
|---|---|---|---|
| 500 V | $3.5 \times 10^9$ | $3.5 \times 10^8$ | $3.0 \times 10^7$ |
| 2,000 V | $3.5 \times 10^9$ | $3.5 \times 10^8$ | $3.0 \times 10^7$ |

EXAMPLE 2

ASAHI THERMAL, FT class, was added in 5.0 parts to the mixture in the above Comparative example 2 to produce a polyurethane foam. This urethane foam was used to made a roller. The roller was subjected to a similar evaluation to that in the Example 1. The measured resistances of the roller are as shown in Table 4. The roller showed a density of 0.56 g/cm$^3$, Asker C hardness of 45° and a mean cell diameter of 150 $\mu$m.

TABLE 4

(in Ω)

| Applied voltage | Environment L/L | N/N | H/H |
|---|---|---|---|
| 500 V | $3.5 \times 10^9$ | $3.5 \times 10^8$ | $3.0 \times 10^7$ |
| 2,000 V | $7.0 \times 10^9$ | $3.5 \times 10^8$ | $3.0 \times 10^7$ |

COMPARATIVE EXAMPLE 3

The above-mentioned KS-555 was added in 0.25 part as ionic conduction-imparting substance to the mixture in the above Example 1. The roller made of a polyurethane foam thus produced showed the resistances as shown in Table 5. The images the roller provided were good in quality in the L/L environment, but the quality of the images produced in the H/H environment was poor. The roller has a density of 0.56 g/cm$^3$, Asker C hardness of 44° and cell diameter of 120 $\mu$m.

TABLE 5

(in Ω)

| Applied voltage | Environment L/L | N/N | H/H |
|---|---|---|---|
| 500 V | $6.0 \times 10^8$ | $6.0 \times 10^7$ | $5.0 \times 10^6$ |
| 2,000 V | $6.0 \times 10^8$ | $6.0 \times 10^7$ | $5.0 \times 10^6$ |

EXAMPLE 3

ASAHI THERMAL, FT class, used in the above Example 1 was added in 10 parts. The polyurethane foam thus produced was used to make a roller which showed a density of 0.56 g/cm$^3$, Asker C hardness of 46° and cell diameter of 180 $\mu$m. The roller was evaluated as in the above Comparative example 1. It showed the resistances as shown in Table 6 and also provided quality images in all the environments.

TABLE 6

(in Ω)

| Applied voltage | Environment L/L | N/N | H/H |
|---|---|---|---|
| 500 V | $3.0 \times 10^9$ | $1.0 \times 10^9$ | $9.0 \times 10^7$ |
| 2,000 V | $2.0 \times 10^8$ | $3.0 \times 10^8$ | $9.0 \times 10^7$ |

EXAMPLE 4

KS-555 was added in 0.05 part to the mixture in the above Example 3 to produce a polyurethane foam. Namely, in this Example 4, both the ion and electron conductions were utilized in combination. The roller made of the polyurethane foam thus produced showed a density of 0.56 g/cm$^3$, Asker C hardness of 46° and cell diameter of 180 $\mu$m. The roller was evaluated as in the above Comparative example 1 and its measured resistances were as shown in Table 7. The roller provided quality images in all the environments.

TABLE 7

(in Ω)

| Applied voltage | Environment L/L | N/N | H/H |
|---|---|---|---|
| 500 V | $3.0 \times 10^9$ | $3.5 \times 10^8$ | $3.0 \times 10^7$ |
| 2,000 V | $2.0 \times 10^8$ | $3.0 \times 10^8$ | $3.0 \times 10^7$ |

COMPARATIVE EXAMPLE 4

In this example, the 5.0 parts of ASAHI THERMAL, FT class, used in the above Example 1, was changed to 20 parts. The polyurethane foam thus produced was used to make a roller of 0.56 g/cm$^3$ in density. However, the cells of the foam were not stable due to the increased viscosity of the materials so that the cell diameter varied from 200 to 800 $\mu$m and the Asker C hardness varied from 44 to 48 $\mu$m. The mean cell diameter was 600 $\mu$m. The roller was evaluated as in the above Comparative example 1. The measured resistances of the roller were as shown in Table 8. The images obtained in all the environments were not uniform due to the irregularly increased cell diameters.

TABLE 8

(in Ω)

| Applied voltage | Environment L/L | N/N | H/H |
|---|---|---|---|
| 500 V | $3.0 \times 10^8$ | $5.5 \times 10^8$ | $9.0 \times 10^7$ |
| 2,000 V | $1.0 \times 10^7$ | $1.8 \times 10^7$ | $2.5 \times 10^7$ |

COMPARATIVE EXAMPLE 5

The amount of ASAHI THERMAL, FT class, in the above Comparative example 4 was adjusted to produce a roller of 0.88 g/cm3 in density. The irregularity of cell diameter disappeared in the roller. The roller cell diameter was 150 $\mu$m and Asker C hardness was 70°. As the result of the evaluation as in the above Comparative example 1, the roller resistances were as shown in Table 9. The images had discontinuities in the dot and line prints.

TABLE 9

(in Ω)

| Applied voltage | Environment L/L | N/N | H/H |
|---|---|---|---|
| 500 V | $2.4 \times 10^8$ | $5.0 \times 10^8$ | $8.5 \times 10^7$ |
| 2,000 V | $9.8 \times 10^6$ | $1.5 \times 10^7$ | $2.2 \times 10^7$ |

Example rollers made of a polyurethane elastomer will be described herebelow.

COMPARATIVE EXAMPLE 6

The same materials as those in the above Comparative example 1 in a same composition were put together into a separable flask and agitated for 3 min while defoaming in a vacuum. After that, the mixture was poured into a mold of 25 mm in inside diameter and 250 mm in length. It was cured as it was heated at 140° C. for 20 min. The resulting urethane elastomer was used to make an electroconductive roller 1 as shown in FIG. 1. The roller 1 has an elastic portion 2 of 20 mm in diameter and 231 mm in length and a shaft 3 of 6 mm in diameter and 262 mm in length. As shown in FIG. 2, the roller 1 was applied with a weight of 500 g at either end of the shaft 3. A resistance meter 4 was used to measure the resistance in ohms (Ω) of the roller 1 when applied with a voltage of 500 V and 2,000 V, respectively, in the L/L, N/N and H/H environments, respectively. The measured resistances were as shown in Table 10. The Asker C hardness of the roller was 70°. For evaluation of the roller, it was used as a developing roller which operates under a constant-current control in a commercially available laser beam printer. The evaluation results were as follows:

The roller provided quality images in the H/H environment, but the quality of the images produced by the roller in the L/L environment was poor.

TABLE 10

(in Ω)

| Applied voltage | Environment L/L | N/N | H/H |
|---|---|---|---|
| 500 V | $9.2 \times 10^9$ | $9.0 \times 10^8$ | $8.2 \times 10^7$ |
| 2,000 V | $9.2 \times 10^9$ | $9.0 \times 10^8$ | $8.2 \times 10^7$ |

EXAMPLE 5

Three parts of carbon black (DIA-BLACK H available from Mitsubishi Chemicals Co., Ltd.) were added to the mixture in the above Comparative example 6 to similarly make a roller. As the result of the evaluation of the roller, the resistances were as shown in Table 11. The roller hardness was Asker C 73°. The quality of the images developed by the roller was good in all the environments.

TABLE 11

(in Ω)

| Applied voltage | Environment L/L | N/N | H/H |
|---|---|---|---|
| 500 V | $4.1 \times 10^8$ | $4.5 \times 10^8$ | $8.2 \times 10^7$ |
| 2,000 V | $1.2 \times 10^8$ | $1.1 \times 10^8$ | $8.2 \times 10^7$ |

COMPARATIVE EXAMPLE 7

Complex of sodium perchlorate [$Ca(ClO_4)_2$] and diethylene glycol monomethyl ether ($CH_3OCH_2CH_2OCH_2OH$) (MP-100E available from Akishima Chemical Industries Co., Ltd.) was added in 0.01 part to the mixture in the above Comparative example 6 to make a roller in a similar manner. The roller showed an Asker C hardness of 70°. The measured resistances of the roller were as shown Table 12. The roller produced quality images in the N/N and H/H environments, but poor images in the L/L environment.

TABLE 12

(in Ω)

| Applied voltage | Environment L/L | N/N | H/H |
|---|---|---|---|
| 500 V | $1.3 \times 10^9$ | $1.2 \times 10^8$ | $1.3 \times 10^7$ |
| 2,000 V | $1.3 \times 10^9$ | $1.2 \times 10^8$ | $1.3 \times 10^7$ |

EXAMPLE 6

Three parts of DIA-BLACK H were added to the mixture in the above Comparative example 7 to make a roller in a similar manner. The roller had an Asker C hardness of 73°, and showed resistances as shown in Table 13. Quality images were produced by this roller in all the environments.

TABLE 13

(in Ω)

| Applied voltage | Environment L/L | N/N | H/H |
|---|---|---|---|
| 500 V | $4.0 \times 10^8$ | $1.2 \times 10^8$ | $1.3 \times 10^7$ |
| 2,000 V | $1.1 \times 10^8$ | $1.1 \times 10^8$ | $1.3 \times 10^7$ |

COMPARATIVE EXAMPLE 8

Eight parts of DIA-BLACK H were added to the same materials as in the above Comparative example 6 to make a roller in a similar manner. The roller had an Asker C hardness of 83°. The measured resistances of the roller are as shown in Table 14. Since the roller was so hard that the roller was in uneven contact with a roller on which a light-sensitive sheet of paper goes, partial nonuniformity took place in the image,

TABLE 14

| | (in Ω) | | |
|---|---|---|---|
| | Environment | | |
| Applied voltage | L/L | N/N | H/H |
| 500 V | $4.5 \times 10^8$ | $9.0 \times 10^8$ | $8.2 \times 10^7$ |
| 2,000 V | $7.6 \times 10^8$ | $1.5 \times 10^7$ | $3.2 \times 10^7$ |

As having been described in the foregoing, the electroconductive roller according to the present invention can work stably in all environmental conditions without any large-capacity power supply and is suitable for use in a constant-current control system. Additionally, the electroconductive roller according to the present invention is suitable for use as a toner supply roller, developing roller, transfer roller, cleaning roller, etc. in a printer of an electrophotography and electrostatic recording systems.

What is claimed is:

1. An electroconductive roller having a resistance of $1\times10^3$ to $1\times10^{12}$ Ω when applied with a voltage of 500 V at a temperature of 25° C. and relative humidity of 50%, and having $K_{HH} \leqq K_{NN} < K_{LL}$, where K is a ratio of resistance at an application of 500 V to resistance at an application of 2,000 V, $K_{HH}$ is the ratio K at 35° C. and 85% relative humidity, $K_{NN}$ is the ratio K at 25° C. and 50% relative humidity, and $K_{LL}$ is the ratio K at 10° C. and 15% relative humidity.

2. An electroconductive roller as set forth in claim 1, made of a polyurethane elastomer of 80° or less in Asker C hardness.

3. An electroconductive roller as set forth in claim 1, made of a polyurethane foam of 65° or less in Asker C hardness and 500 μm or less in mean cell diameter.

4. An electrophotography system comprising an electroconductive roller as set forth in any one of claims 1 to 3, a constant-current control and a power source having controls for providing a stepwisely generated voltage corresponding to an increasing load resistance.

* * * * *